US006571077B2

(12) United States Patent
Thompson et al.

(10) Patent No.: US 6,571,077 B2
(45) Date of Patent: May 27, 2003

(54) ELECTROSTATIC IMAGE DEVELOPING METHOD AND APPARATUS USING A DRUM PHOTOCONDUCTOR AND HARD MAGNETIC CARRIERS

(75) Inventors: John R. Thompson, Webster, NY (US); Timothy G. Armstrong, Rochester, NY (US); Richard G. Allen, Irondequoit, NY (US); Thomas Hilbert, Spencerport, NY (US); Christopher S. Garcia, Rochester, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/859,129

(22) Filed: May 16, 2001

(65) Prior Publication Data

US 2002/0031376 A1 Mar. 14, 2002

Related U.S. Application Data

(60) Provisional application No. 60/204,881, filed on May 17, 2000.

(51) Int. Cl.[7] ..... G03G 15/09

(52) U.S. Cl. ..... 399/267; 399/272; 399/274; 399/276; 430/122

(58) Field of Search ..... 399/267, 272, 399/274–276; 430/122

(56) References Cited

U.S. PATENT DOCUMENTS

| | | | |
|---|---|---|---|
| 4,473,029 | A | 9/1984 | Fritz et al. |
| 4,496,643 | A | 1/1985 | Wilson et al. |
| 4,531,832 | A | 7/1985 | Kroll et al. |
| 4,546,060 | A | 10/1985 | Miskinis et al. |
| 4,585,328 | A | 4/1986 | Moser et al. |
| 4,634,286 | A | 1/1987 | Pike |
| 4,671,207 | A | 6/1987 | Hilbert |
| 4,714,046 | A | 12/1987 | Steele et al. |
| 4,764,445 | A | 8/1988 | Miskinis et al. |
| 4,825,244 | A | 4/1989 | Hediger |
| 4,887,132 | A | 12/1989 | Joseph et al. |
| 4,922,302 | A | 5/1990 | Hill et al. |
| 4,967,236 | A | 10/1990 | Rodenberg et al. |
| 5,001,028 | A | 3/1991 | Mosehauer et al. |
| 5,019,796 | A | 5/1991 | Lee et al. |
| 5,040,003 | A | 8/1991 | Willis |
| 5,043,760 | A | 8/1991 | MacLellan et al. |
| 5,045,886 | A | 9/1991 | Weitzel et al. |
| 5,047,807 | A | 9/1991 | Kalyandurg |
| 5,061,586 | A | 10/1991 | Saha et al. |
| 5,063,399 | A | 11/1991 | Zeman et al. |
| 5,066,981 | A | 11/1991 | Kalyandurg |
| 5,084,739 | A | 1/1992 | Kalyandurg et al. |
| 5,095,340 | A | 3/1992 | Mahoney |
| 5,104,761 | A | 4/1992 | Saha et al. |
| 5,106,714 | A | 4/1992 | Saha et al. |
| 5,111,245 | A | 5/1992 | DeCecca et al. |
| 5,132,732 | A | 7/1992 | Kalyandurg et al. |
| 5,138,388 | A | 8/1992 | Kamp et al. |
| 5,146,278 | A | 9/1992 | Kroll et al. |
| 5,148,220 | A | 9/1992 | Hilbert et al. |
| 5,162,854 | A | 11/1992 | Hilbert et al. |
| 5,182,608 | A | 1/1993 | Kroll et al. |
| 5,184,194 | A | 2/1993 | Mosehauer et al. |

(List continued on next page.)

OTHER PUBLICATIONS

PCT International Search Report.

*Primary Examiner*—William J. Royer
(74) *Attorney, Agent, or Firm*—Kevin L. Leffel

(57) ABSTRACT

The invention relates generally to apparatus for electrostatic image development and, in particular, apparatus that implement a magnetic brush with a drum photoconductor. According to an aspect of the invention, a method and apparatus for developing an electrostatic image are provided implementing a drum photoconductor and a magnetic brush contacting the drum photoconductor. The magnetic brush includes a mixture of toner and hard magnetic carriers.

12 Claims, 9 Drawing Sheets

U.S. PATENT DOCUMENTS 5,190,841 A 3/1993 Saha et al.
5,190,842 A 3/1993 Saha et al.
5,196,887 A 3/1993 Hilbert et al.
5,227,265 A 7/1993 DeBoer et al.
5,237,127 A 8/1993 DeCecca et al.
5,241,327 A 8/1993 Rubin et al.
5,245,388 A 9/1993 Rydelek et al.
5,247,331 A 9/1993 Rydelek
5,268,249 A 12/1993 Saha et al.
5,280,302 A 1/1994 Rubin et al.
5,291,259 A 3/1994 Weitzel et al.
5,293,201 A 3/1994 Kamp et al.
5,296,898 A 3/1994 Rubin et al.
5,296,905 A 3/1994 Yousey et al.
5,298,358 A 3/1994 Rubin et al.
5,300,988 A 4/1994 Westbrook et al.
5,306,592 A 4/1994 Saha
5,325,161 A 6/1994 Saha et al.
5,332,645 A 7/1994 Saha et al.
5,339,140 A 8/1994 Zeman et al.
5,344,731 A 9/1994 Deboer et al.
5,347,345 A 9/1994 Osterhoudt
5,347,347 A 9/1994 Hilbert et al.
5,376,492 A * 12/1994 Stelter et al. ..... 430/122
5,400,124 A 3/1995 Kass et al.
5,409,791 A 4/1995 Kaukeinen et al.
5,489,975 A 2/1996 Kaukeinen et al.
5,500,320 A 3/1996 Saha
5,512,404 A 4/1996 Saha
5,592,268 A 1/1997 Uehara et al.
5,606,404 A * 2/1997 Hilbert et al. ..... 399/267
5,640,656 A 6/1997 Hilbert et al.
5,701,550 A 12/1997 Lofftus et al.
5,705,307 A 1/1998 Tyagi et al.
5,713,064 A 1/1998 Kasiske et al.
5,732,311 A 3/1998 May et al.
5,748,218 A 5/1998 Stelter et al.
5,835,832 A 11/1998 Rimal et al.
5,853,941 A * 12/1998 Rimai et al. ..... 430/122
5,923,937 A 7/1999 Thompson et al.
5,926,679 A 7/1999 May et al.
5,998,076 A 12/1999 Mahabadi et al.
6,070,037 A 5/2000 Sugihara et al.

* cited by examiner

ELECTROSTATIC IMAGE DEVELOPING METHOD AND APPARATUS USING A DRUM PHOTOCONDUCTOR AND HARD MAGNETIC CARRIERS

This application claims the benefit of U.S. Provisional Application No. 60/204,881, filed May 17, 2000.

BACKGROUND

The invention relates generally to apparatus for electrostatic image development and, in particular, apparatus that implement a magnetic brush with a drum photoconductor.

Development apparatus and processes that implement a magnetic brush to deposit toner on a photoconductor have been known for many years. Development apparatus and processes that implement a magnetic brush having hard magnetic carriers are described in U.S. Pat. Nos. 4,473,029 and 4,546,060. The apparatus described in those patents implements a rotating shell coated with a mixture of hard magnetic carrier particles and toner, a rotating magnetic core having a multitude of magnetic poles disposed within the rotating shell, and a film (sheet-like) photoconductor. The rotating magnetic core causes the hard magnetic carrier particles to tumble on the surface of the shell, which provides increased agitation and toner contact with the film photoconductor.

The two-component dry developer composition of U.S. Pat. No. 4,546,060 comprises charged toner particles and oppositely charged, magnetic carrier particles, which (a) comprise a magnetic material exhibiting "hard" magnetic properties, as characterized by a coercivity of at least 300 gauss and (b) exhibit an induced magnetic moment of at least 20 EMU/gm when in an applied field of 1000 gauss, is disclosed. As described in the '060 patent, the developer is employed in combination with a magnetic applicator comprising a rotatable magnetic core and an outer, nonmagnetizable shell to develop electrostatic images. When hard magnetic carrier particles are employed, exposure to a succession of magnetic fields emanating from the rotating core applicator causes the particles to flip or turn to move into magnetic alignment in each new field. Each flip, moreover, as a consequence of both the magnetic moment of the particles and the coercivity of the magnetic material, is accompanied by a rapid circumferential step by each particle in a direction opposite the movement of the rotating core. The observed result is that the developers of the '060 flow smoothly and at a rapid rate around the shell while the core rotates in the opposite direction, thus rapidly delivering fresh toner to the film photoconductor and facilitating high-volume copy and printer applications.

Prior applications of hard magnetic carriers have implemented a flexible photoconductor in the form of a film. Flexible or film based photoconductors have several significant advantage for high speed photocopying. In a typical apparatus, the film photoconductor is positioned under moderate tension with a series of rollers. There is an inherent resilience in the film photoconductor that allows it to respond to variations in the thickness of the magnetic brush.

Drum photoconductors are also known in the art, but have not been used with magnetic brushes having hard magnetic carriers. At least part of the reason drum photoconductors have not been used is because they tend to be far more rigid than a film photoconductor, and increasing thickness of the magnetic brush can damage the surface of the drum photoconductor. Conversely, decreasing thickness of the magnetic brush can cause insufficient contact with the drum photoconductor and poor image development.

SUMMARY

According to an aspect of the invention, an apparatus for developing an electrostatic image is provided, comprising a drum photoconductor and a magnetic brush contacting the drum photoconductor, a magnetic brush contacting said drum photoconductor, said magnetic brush comprising a mixture of toner and hard magnetic carriers.

According to a further aspect of the invention, a method for developing an electrostatic image is provided comprising applying a mixture of toner and hard magnetic carriers to a drum photoconductor with a magnetic brush.

According to a further aspect of the invention, a method for developing an electrostatic image is provided comprising applying a mixture of toner and hard magnetic carriers to a drum photoconductor with a magnetic brush comprising a magnetic core within a shell having a center of rotation, and the magnetic core is offset relative to the center of rotation toward the drum photoconductor.

According to a further aspect of the invention an apparatus for developing an electrostatic image is provided, comprising a drum photoconductor, a magnetic. brush contacting the drum photoconductor, the magnetic brush comprising a mixture of toner and hard magnetic carriers, the magnetic brush comprising a rotatable magnetic core within a shell.

According to a further aspect of the invention an apparatus for developing an electrostatic image is provided, comprising a drum photoconductor, a magnetic brush contacting the drum photoconductor, the magnetic brush comprising a mixture of toner and hard magnetic carriers, the magnetic brush comprising a rotatable magnetic core within a rotatable shell.

According to a further aspect of the invention an apparatus for developing an electrostatic image is provided, comprising a drum photoconductor, a magnetic brush contacting the drum photoconductor, the magnetic brush comprising a mixture of toner and hard magnetic carriers, the magnetic brush comprising a magnetic core within a rotatable shell, the magnetic core being rotatable in a direction of rotation and the shell being rotatable in a direction opposite to the direction of rotation of the magnetic core.

According to a still further aspect of the invention a method for developing an electrostatic image is provided, applying a magnetic brush to a drum photoconductor, said magnetic brush comprising a mixture of toner and hard magnetic carriers with a mass flow rate, and limiting said mass flow rate of the mixture to be less than a limiting mass flow rate for which roll-back occurs.

DETAILED DESCRIPTION

Figure 1:
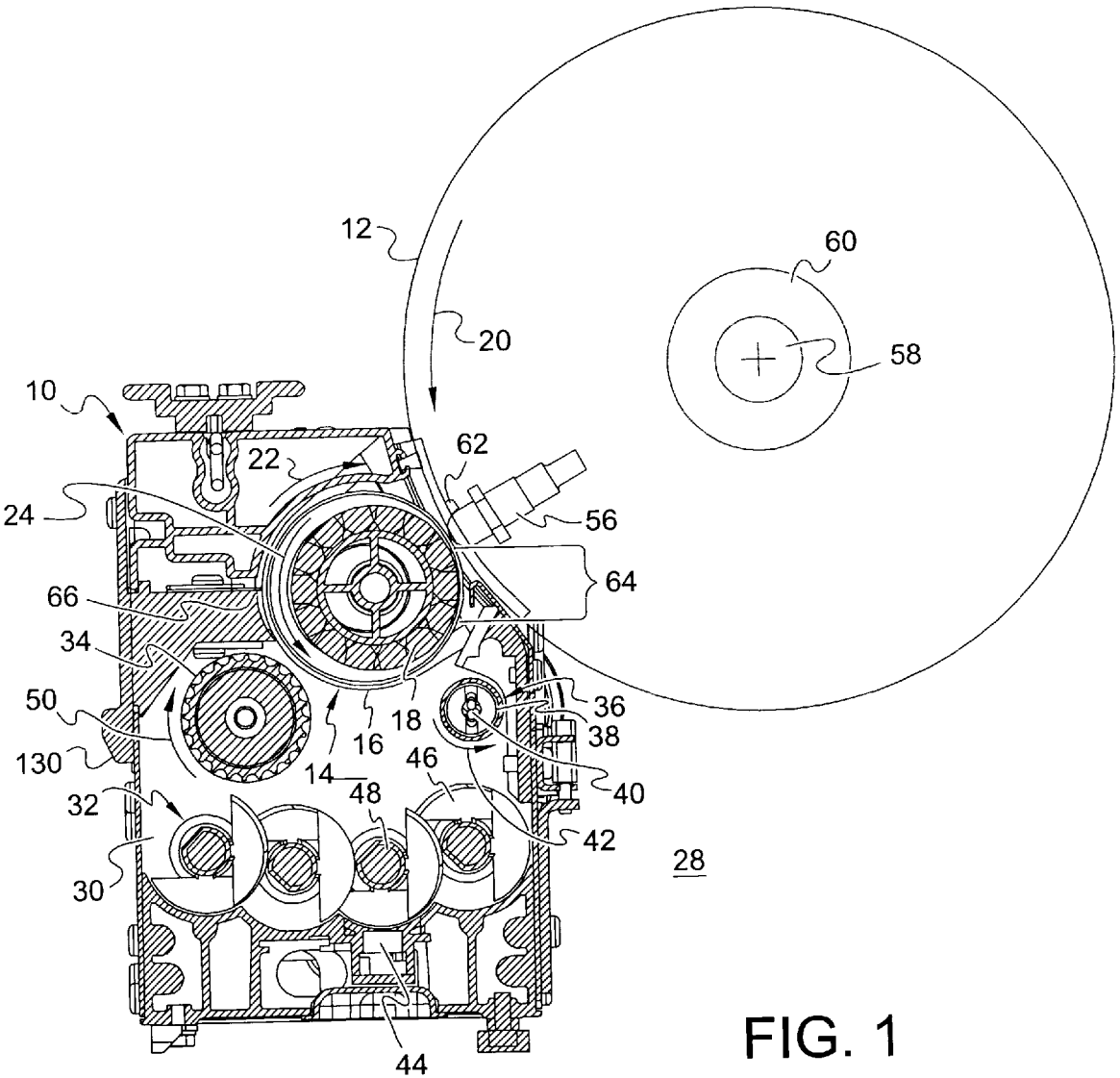
FIG. 1 presents an end view of a development apparatus according to an aspect of the invention, including a cross-sectional view of a toning station according to an aspect of the invention.

Various aspects of the invention are presented in FIGS. 1–12, which are not drawn to scale, and wherein components in the numerous views are numbered alike. Referring now to FIG. 1, a toning station 10 is presented, according to an aspect of the invention, comprising a drum photoconductor 12 and a magnetic brush 14 that carries a mixture of toner and hard magnetic carriers into contact with the external surface of the drum photoconductor 12. As used herein, the term "hard magnetic carriers" means carriers having hard magnetic properties, as described in the Background section. The magnetic brush 14 operates according to the principles described in U.S. Pat. Nos. 4,473,029 and 4,546,060, the contents of which are fully incorporated by reference as if set forth herein. The magnetic brush 14 comprises a shell 16, preferably of non-magnetizable material, and a magnetic core 18 comprising a rotating plurality of magnetic poles. The drum photoconductor 12 rotates in the direction indicated by the arrow 20 (drum photoconductor 12 direction of rotation), the shell 16 rotates in the direction indicated by the arrow 22 (shell 16 direction of rotation), and the magnetic core 18 rotates in the direction indicated by the arrow 24 (magnetic core 18 direction of rotation).

For the purposes of this description, the drum photoconductor 12 has a direction of rotation 20 that is opposite the direction of rotation 22 of the shell 16, and drum photoconductor 12 has a direction of rotation 20 that is co-directional with the direction of rotation 24 of the magnetic core 18. The various directions of rotation are not so limited in the practice of the invention, and may be changed as may be suited for a particular application.

The toning station 10 and the drum photoconductor 12 are mounted to a frame 28 that is configured, as needed, for a particular copy machine or printer application, as desired. The toning station 10 comprises a shell 16, a sump 30, quadruple augers 32 mounted for rotation in the sump 30, a transport roller 34 above the augers 32 adjacent the shell 16, and a replenishment unit 36 that comprises a fixed perforated tube 38, and a replenishment brush 40 inside the tube 38 that rotates in the direction of arrow 42. The replenishment unit 36 adds toner to the toner/carrier mixture in response to a toner concentration monitor 44 to maintain a weight ratio of toner to carrier, for example 1/10. More or less such components may be added or removed depending upon the particular application.

The additional mixing provided by a four auger system improves cross mixing and, therefore, cross track uniformity in a developed image. Toner concentration gradients are preferably minimized, and no more than a few percent in magnitude.

In use, the mixture of hard magnetic carriers and toner covers the augers 32 to a level about even with the bottom of the transport roller 34. The augers 32 comprise a multitude of angled blades 46 mounted on shafts 48. The blades mix the carriers and toners to create tribocharging and uniformity, and to provide a generally even level of toner/carrier mixture in the sump 30. The transport roller 34 rotates in the direction of arrow 50 and lifts the mixture out of the sump 30 to the shell 16.

Figure 3:
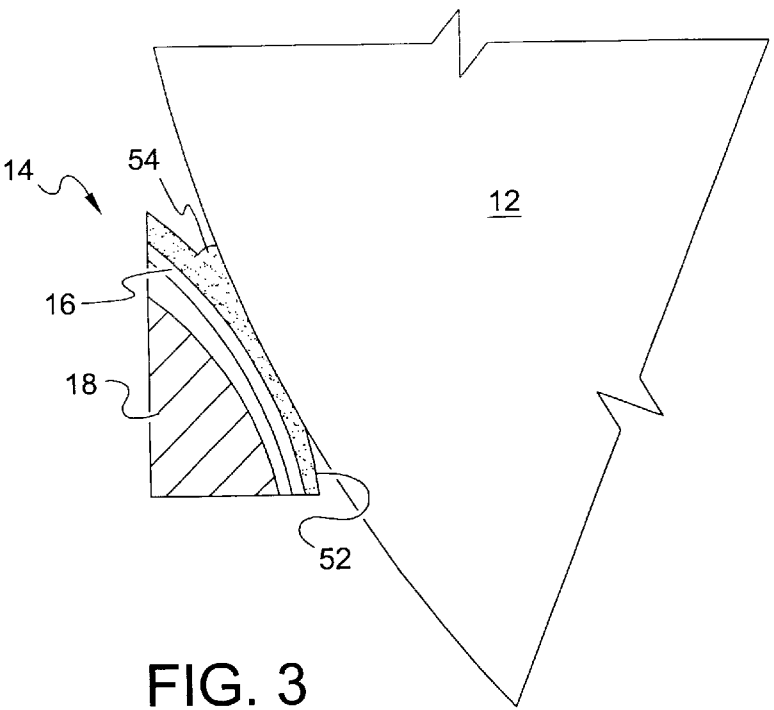
FIG. 3 presents an enlarged view of a development zone having a roll-back region.
Figure 2:
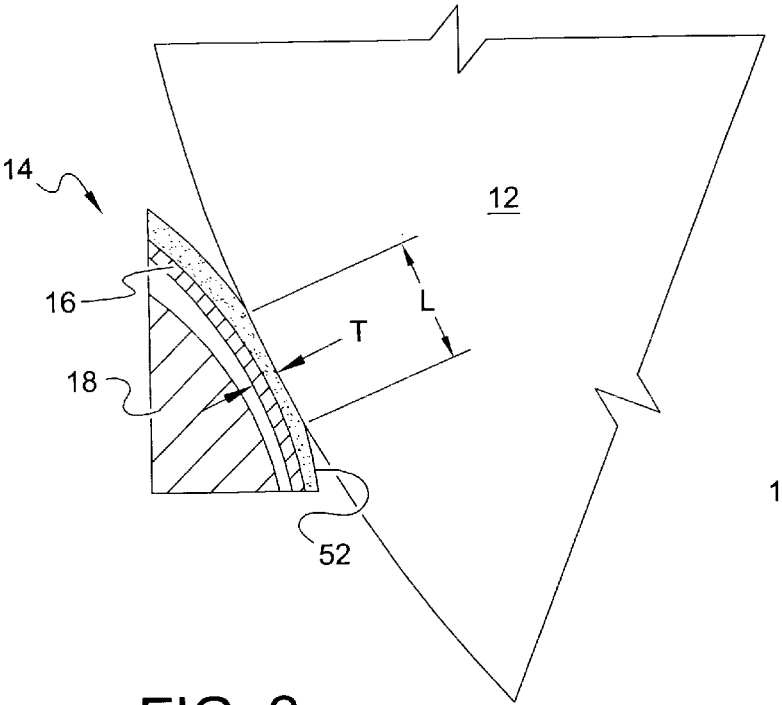
FIG. 2 presents an enlarged view of a development zone according to an aspect of the invention.

Referring now to FIG. 2, an enlarged view of the nip area of FIG. 1 is presented, showing where a toner/carrier mixture 52 coating the shell 16 contacts the drum photoconductor 12. The flow of toner/carrier mixture 52 has a thickness T, and contacts the drum photoconductor 12 over a length L. The flow presented in FIG. 2 is very desirable. Referring now to FIG. 3, an undesirable flow of the toner/carrier mixture 52 is presented wherein a roll-back region 54 has developed. The roll-back region 54 is believed to be caused by the flow of toner/carrier mixture 52 being greater than can flow through the nip between the shell 16 and the drum photoconductor 12. The roll-back region may cause artifacts in the image development on drum photoconductor 12, and may also physically damage the surface of the drum photoconductor 12. The roll-back region 54 is not passive since the rotating magnetic core 18 tends to drive the mass of material in the roll-back region 54 into the nip with an active force.

According to an aspect of the invention, development of the roll-back region is avoided. According to a further aspect of the invention, development of the roll-back region is avoided at least in part by accurately and repeatably locating the shell 16 a predetermined distance from the drum 12. Referring again to FIG. 1, the registration of the shell 16 to the drum 12 is controlled by providing a pair of registration pins 56 on either side of the drum 12. The drum 12 comprises a shaft 58 that is mounted in a pair of bearings 60 that, in turn, are mounted to the frame 28.

The toning station 10 comprises a pair of registration shoes 62 on either end that mate with the pins 56. According to a preferred embodiment, the magnetic brush 14 is registered to the drum photoconductor 12. For example, the toning station 10 is wedged into registration with the pins 56 thereby rendering it immovable during operation of the drum photoconductor 12 and magnetic brush 14. The registration shoe 62 presented in FIG. 1 is mostly hidden behind the toning station 10. A better representation is provided in FIG. 12, which will be discussed in more detail.

According to a further aspect of the invention, development of the roll-back region is avoided at least in part by accurately controlling the thickness of the toner/carrier mixture 52 in the nip between the shell 16 and the drum 12. The center of rotation of the core 18 may be offset relative to the center of rotation of the shell toward the drum 12 (eccentric), thereby forming an area 64 wherein the inside surface of the shell 16 is closest to the outside surface of the core 18 (slightly below the point where the drum 14 and the shell are closest), referred to herein as the perigee. A metering skive 66 is located opposite the area 64 where the shell 16 is furthest from the core 18, referred to herein as the apogee. The metering skive 66 meters a predetermined thickness of toner/carrier mixture onto the shell 16. The magnetic field applied to the toner/carrier mixture is weakest at this point, so it is not fully compacted. The thickness of the mixture decreases as it is carried around the shell to the drum 12. Therefore, any variation in the thickness decreases along with the thickness of the mixture, thereby providing a more precise thickness T. According to a preferred embodiment, a line drawn from the area 64 (the perigee) to the metering skive 66 is horizontal, and the two are 180° apart (one at the 9 o'clock position, the other at the 3 o'clock position).

According to a preferred embodiment, the flow of the toner/carrier mixture 52 is limited to be less than the limiting mass flow rate through the nip between the drum photoconductor 12 and the shell 16 for which roll-back occurs. This may be accomplished, at least in part by adjusting the skive gap (the distance between the skive 66 and shell 16) to achieve a predetermined mass flow of toner/carrier mixture 52 per unit length past the skive 66 that is less than the limiting mass flow rate. Mass flow rate of the toner/carrier mixture is also affected by numerous other parameters including speed and direction of rotation of the various rotating components, and the dimensions and physical properties of the toner/carrier mixture and various components of the development station, for example the magnetic field strength of the core. This list is not intended to be exhaustive since the effects and the limiting mass flow rate for a particular application may be determined by experimental observation and measurement.

Figure 4:
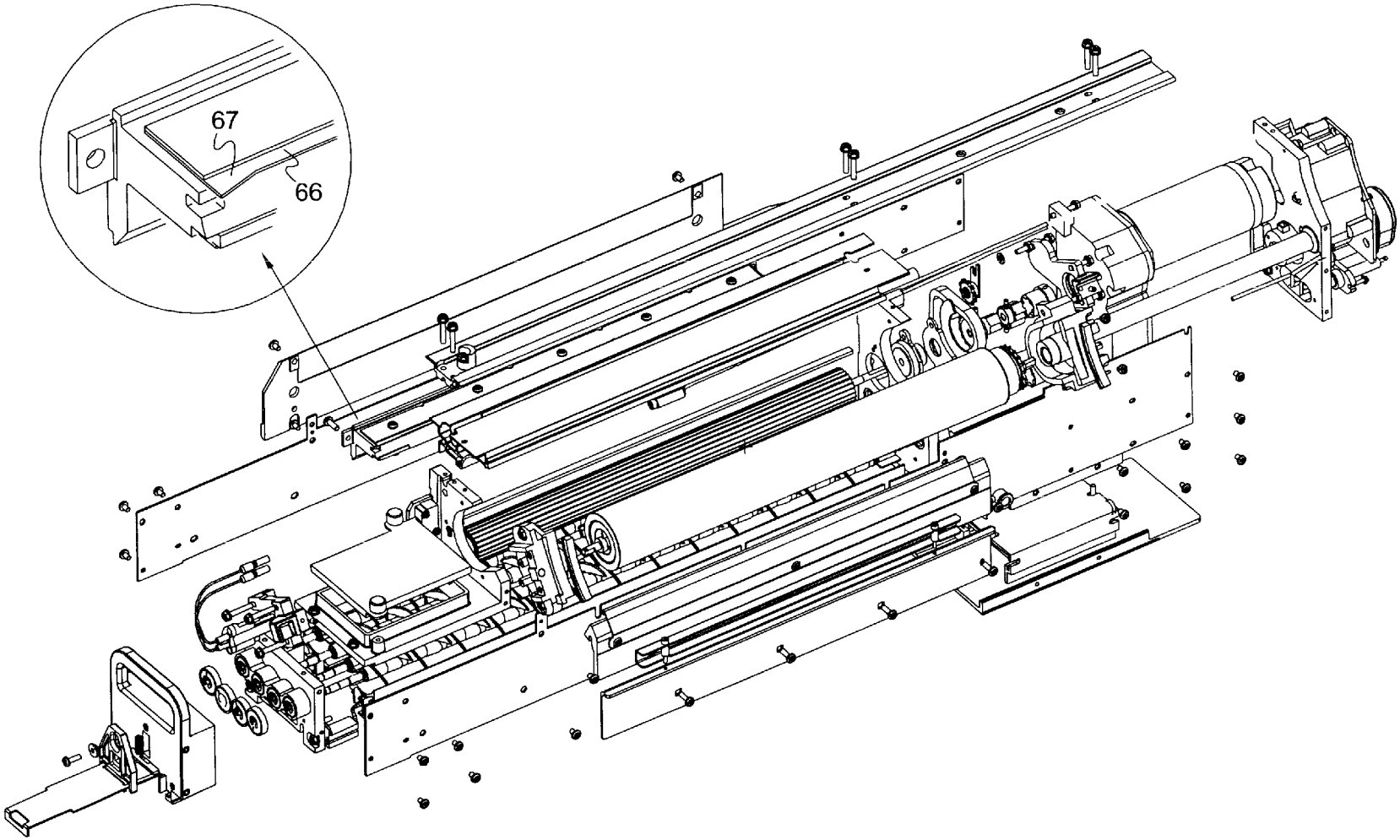
FIG. 4 presents an exploded perspective view of the FIG. 1 toning station.
Figure 5:
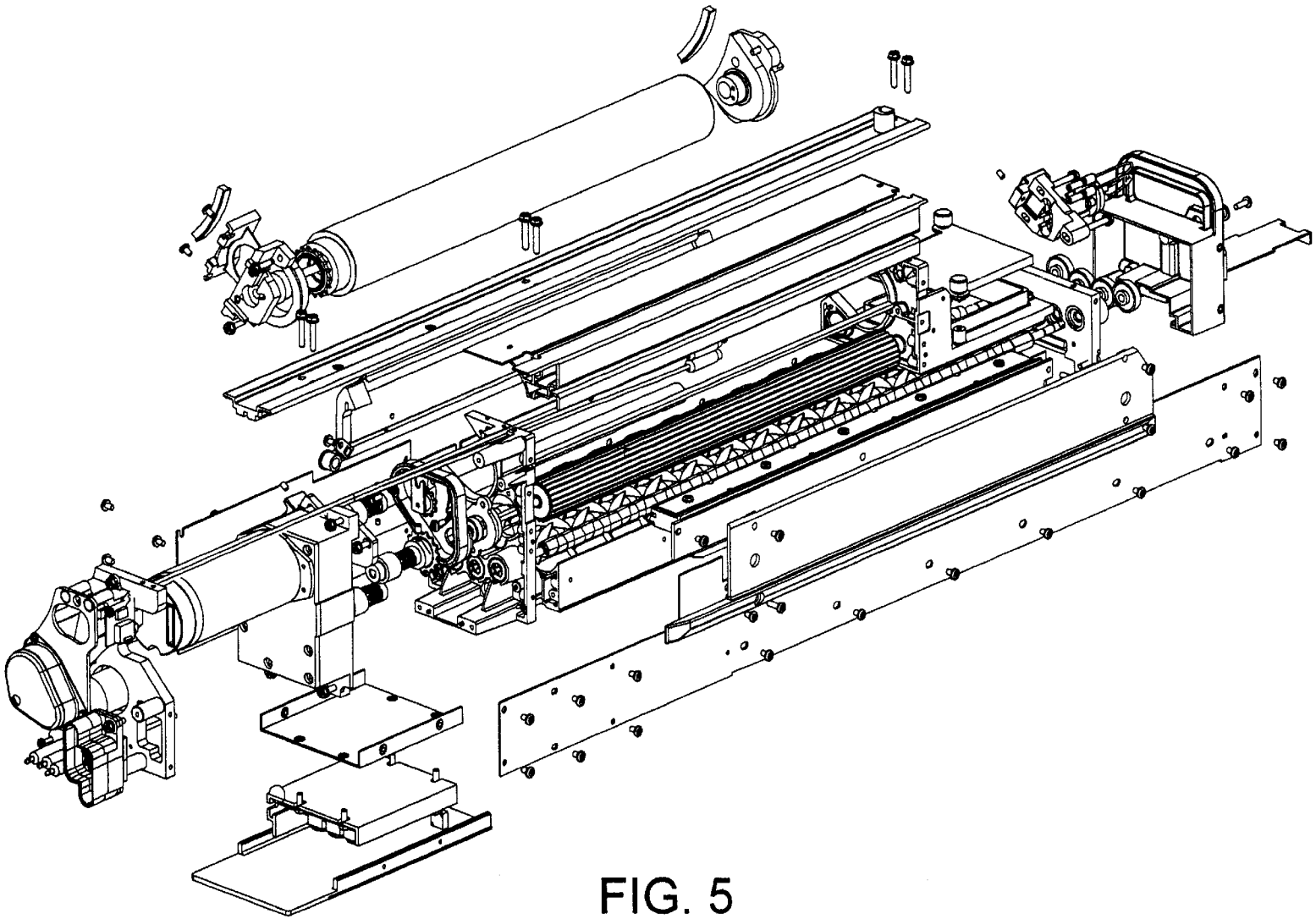
FIG. 5 presents an exploded perspective view of the FIG. 1 toning station from an opposite end thereof as that presented in FIG. 4.
Figure 6:
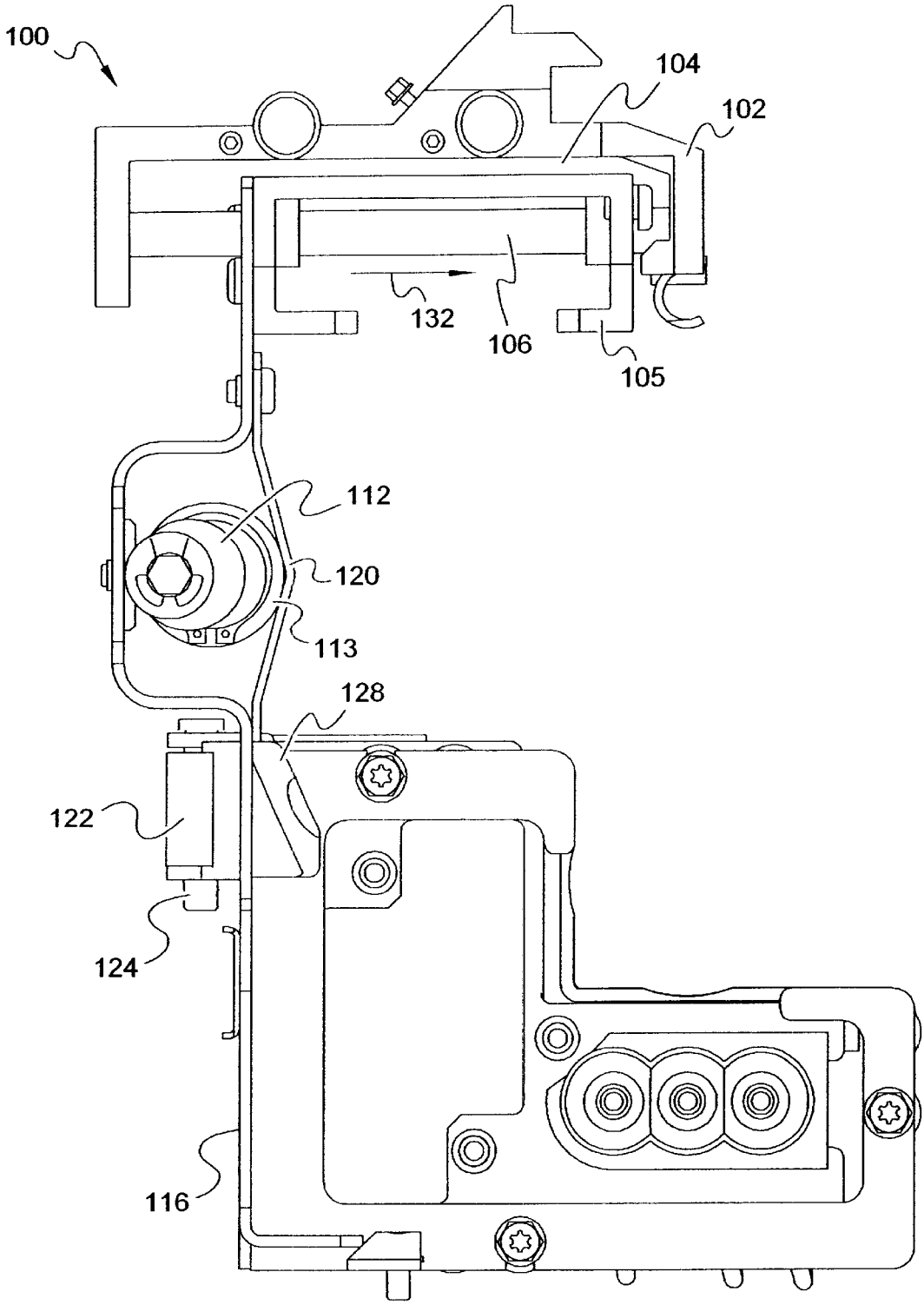
FIG. 6 presents an end view of a toning station carriage assembly according to an aspect of the invention.
Figure 7:
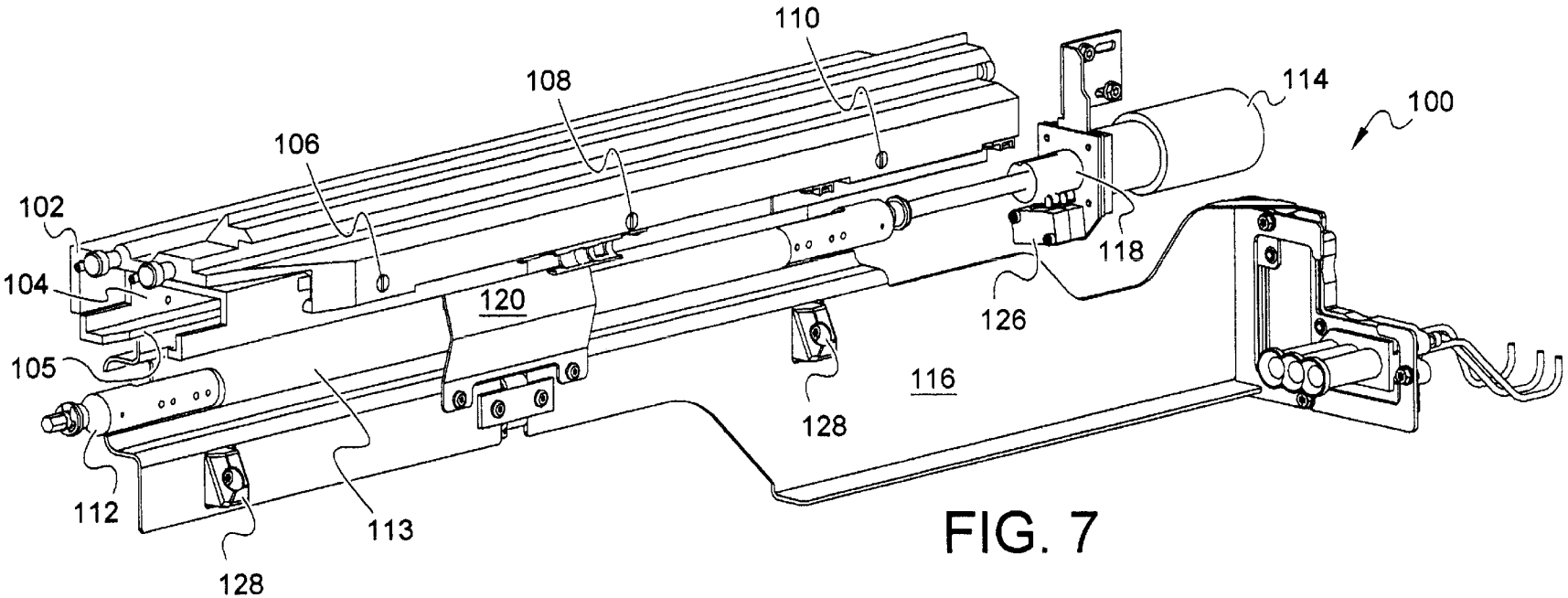
FIG. 7 presents a perspective view of the carriage assembly of FIG. 6.

Referring now to FIGS. 4 and 5, exploded isometric views of the toning station 10 from opposite ends are presented in order to show additional detail, and the relative relation of the components.

The rotating magnetic core 18 may develop eddy current losses in the drum photoconductor 12. A combination of relatively fine magnetic pole frequency (for example a 14 pole, 1.6 inch diameter) and relatively thin, 4 to 8 mm, wall thickness for the drum photoconductor 12 reduces eddy current losses. Further, the material choice for the drum wall of a relatively hard aluminum (T3 or T6) minimizes the wall conductivity, and therefore, the eddy current losses.

According to a further aspect of the invention, the metering skive 66 is provided with wings 67 at both ends that locally reduce the flow of the toner/carrier mixture proximate the ends of the drum photoconductor 12. Reducing the flow in such manner prevents physical damage that may occur at the very ends of the development zone due to edge effects that locally increase flow. Further reductions in the rate of formation of rollback regions at the ends of the development zone were obtained by placing small permanent magnets on the metering skive 66 at the wing locations 67.

A DC bias is applied to the shell 16 in order to create an electric field that transports toner to the surface of the drum photoconductor 12. An AC bias may also be implemented to improve the development rate, and therefore the level and consistency of image quality. In solid area development systems, an electrical bias is applied between the ground layer of the drum photoconductor and the shell of the development station. If a high frequency, high voltage, e.g. 1000 to 2000 hertz and 500 to 1500 volt rms, signal is added to the constant bias, the development rate is significantly increased.

Figure 8:
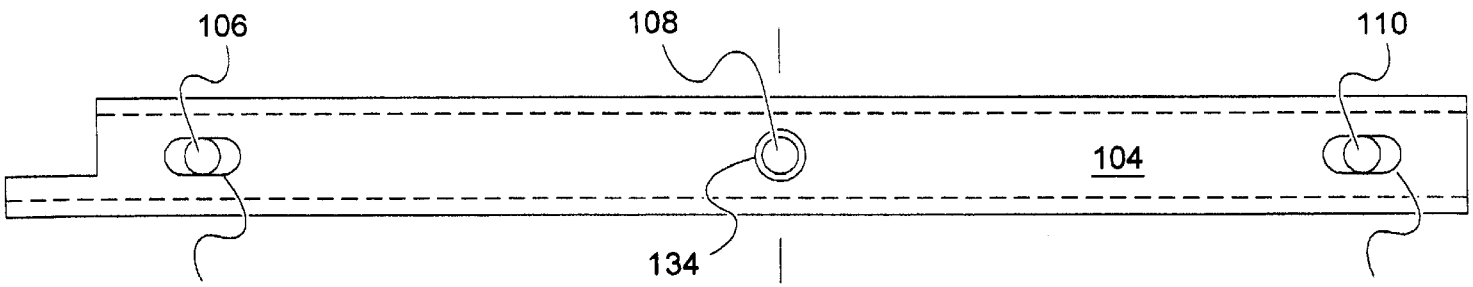
FIG. 8 presents a side plan view of a sliding rail implemented in the carriage assembly of FIG. 6.
Figure 9:
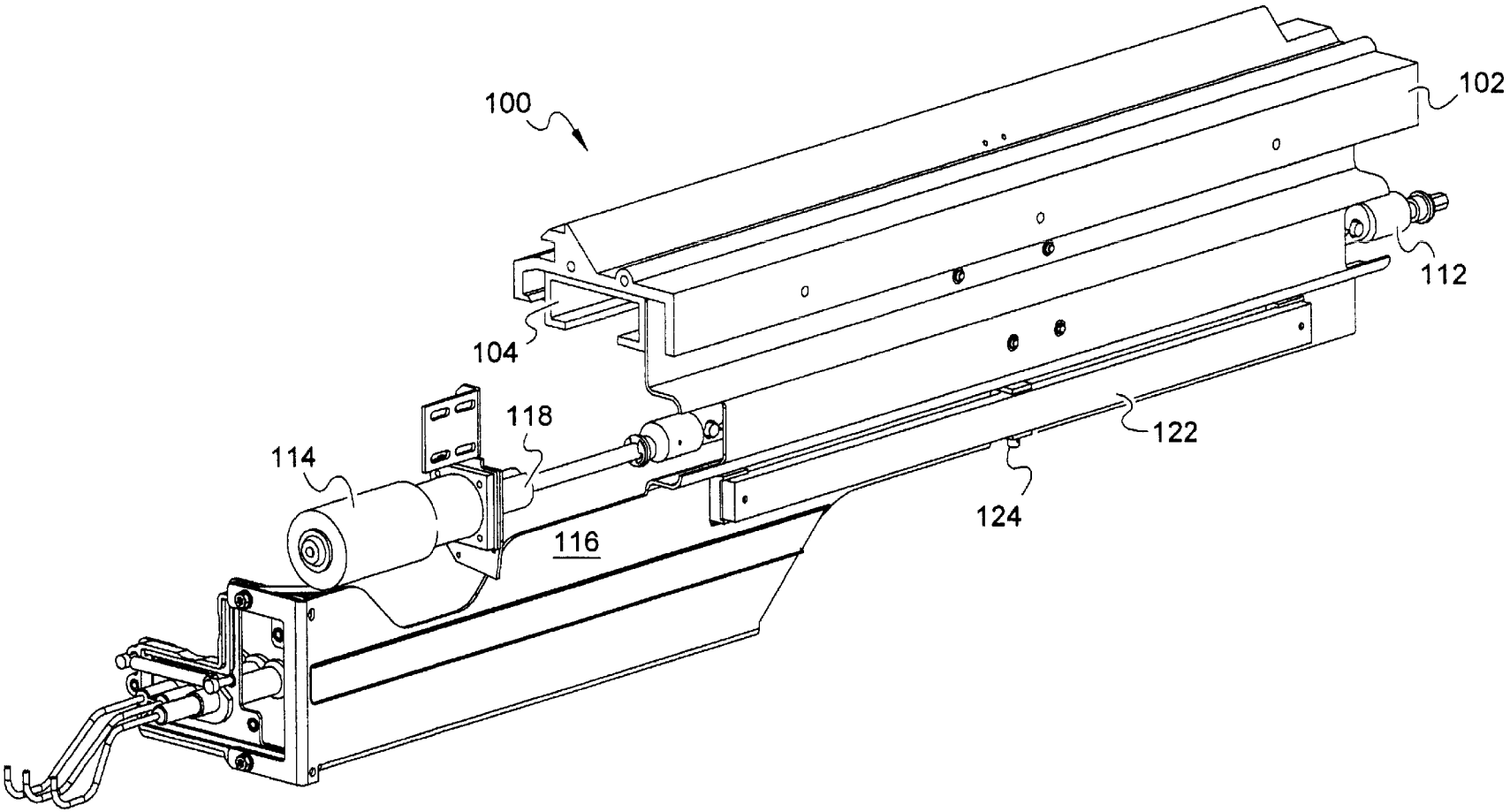
FIG. 9 presents a perspective view of the carriage assembly of FIG. 6 from an opposite end thereof as that presented in FIG. 7.
Figure 10:
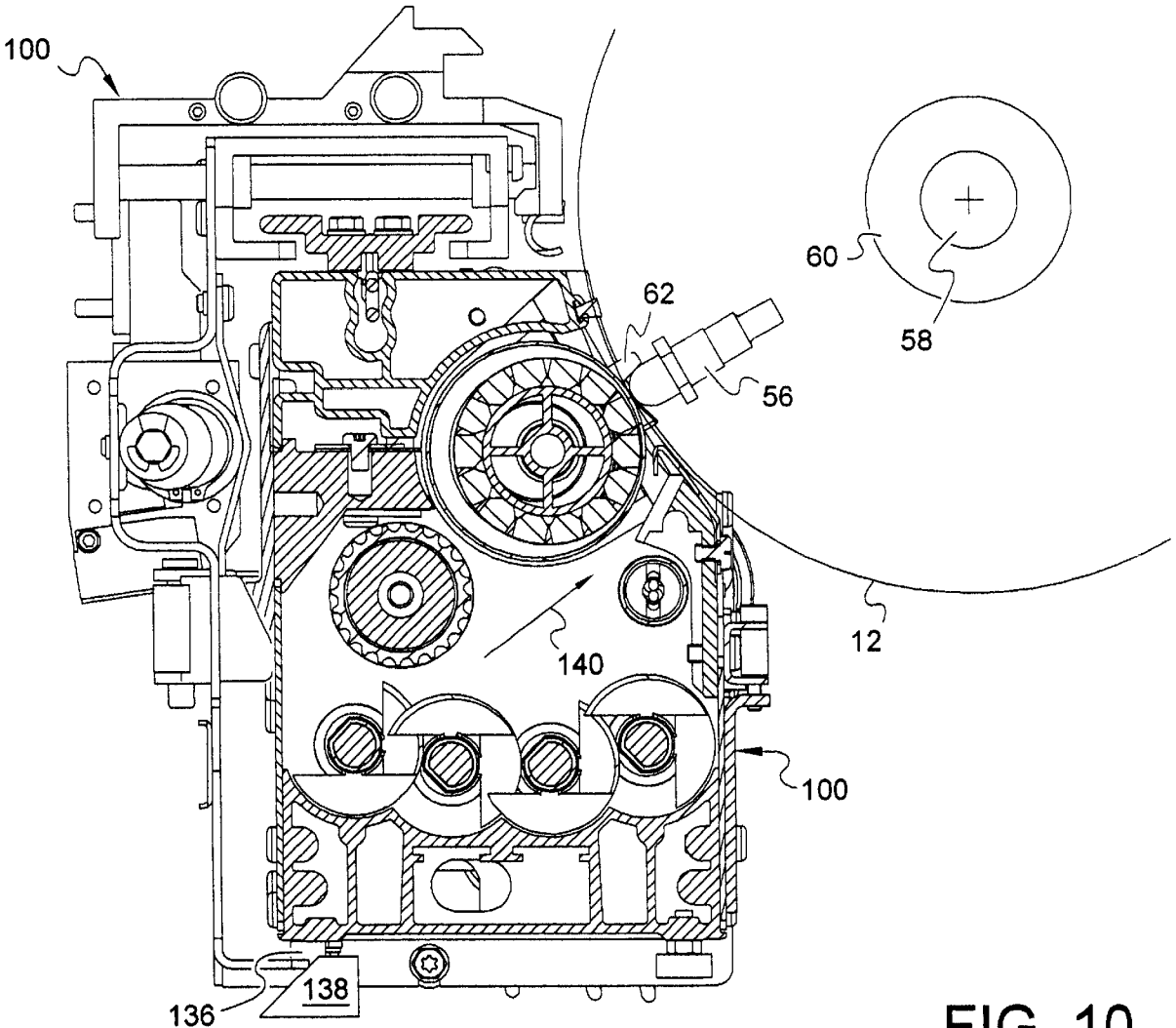
FIG. 10 presents an end view of the carriage assembly of FIG. 6 with the toning station of FIG. 1 registered with a drum photoconductor.
Figure 12:
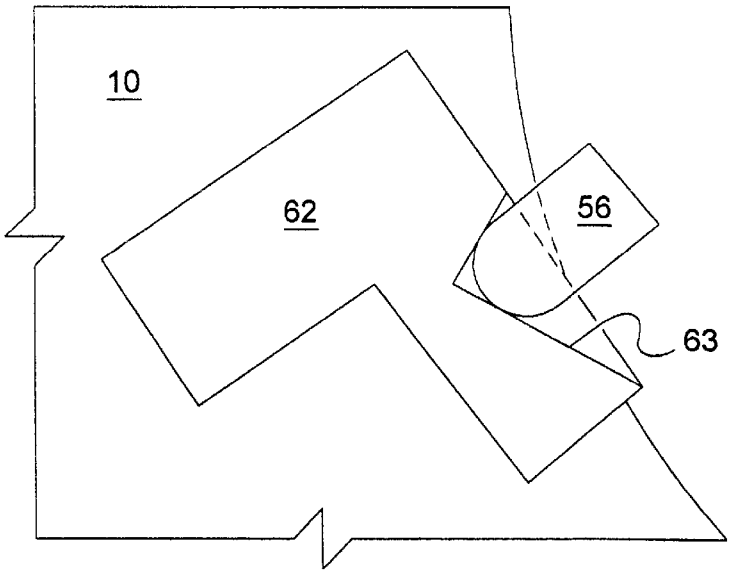
FIG. 12 presents an enlarged view of a registration shoe and registration pin in a registered state.
Figure 11:
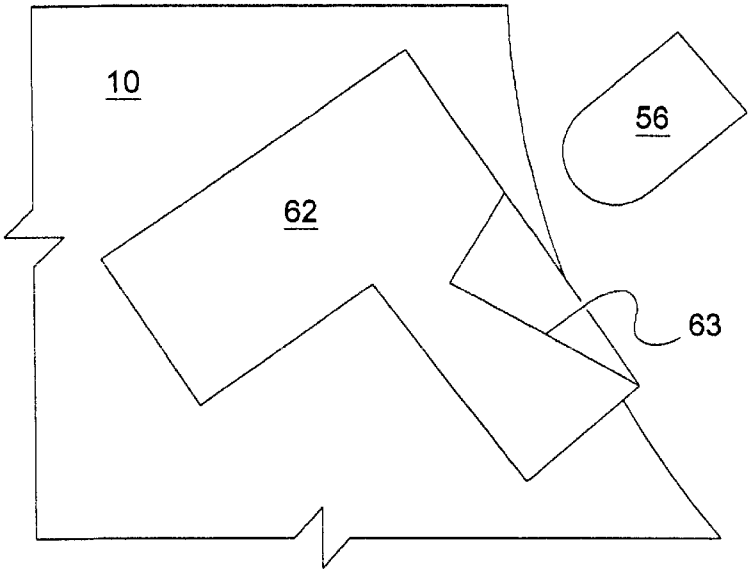
FIG. 11 presents an enlarged view of a registration shoe and registration pin in an unregistered state.

Referring now to FIGS. 6–12, a carriage assembly 100 is presented according to a further aspect of the invention, that may be employed in combination with the toning station 10 (FIGS. 1 and 10) to provide precise registration of the toning station with the drum photoconductor 12 (FIGS. 1 and 10). The carriage assembly 100 compensates for skew in the drum photoconductor 12. Referring now to FIGS. 6–9, the carriage assembly 100 comprises a support rail 102 and a sliding rail 104 suspended and guided by three rods 106, 108, and 110. The support rail 102 is rigidly attached to a structure, such as the frame 28 of FIG. 1. As best shown in FIG. 8, the sliding rail 104 comprises two horizontally elongated holes 132 that receive the outer rods 106, and 110, and a slightly oversized hole 134. The center rod 108 constrains movement of the sliding rail 104 in the longitudinal direction while allowing lateral movement of the sliding rail 104 along the rod 108. The two outside rods 106 and 110 maintain levelness of the sliding rail 104.

Referring again to FIGS. 6–9, the sliding rail 104 is attached to a side plate 116. A camshaft 112 is driven by an electrical actuator motor 114, and is captured between two components of the side plate 116 and provides the mechanism for positioning the sliding rail 104 relative to the photoconductor drum 12. The electrical actuator motor 114 is rigidly mounted to the same support structure as the support rail 102. The camshaft 112 comprises a cam bearing 113. A load arm 122 is also attached to the side plate 116 and pivoted about a vertical axis at a load arm pivot 124. The position of camshaft 112 is controlled through the use of two solid state micro switches 126 and a cam position coupling 118.

As the camshaft 112 is rotated from a disengaged position to an engaged position it pushes against a detented cam retainer plate 120 attached to the side plate 116. This motion pushes the sliding rail 104 into its engaged position, best shown in FIG. 6, as indicated by arrow 132. As the sliding rail 104 travels to its engaged position, the load arm 122 mounted to the side plate 116 encounters the toning station 10 (FIGS. 1 and 10) and is deflected thereby creating a spring force that pushes the toning station 10 into registration with the registration pins 56 (FIGS. 1 and 10). The detented cam retainer plate 120 provides a nesting force so that the camshaft 112 does not rotate away when the mechanism is in the engaged position.

Still referring to FIGS. 6–9, a positive vertical lift force is achieved through the use of two angled push pads 128 mounted on the load arm 122 and a corresponding angled wedge 130 mounted to the toning station 10 (see FIGS. 1 and 10). The push pads 128 pass through a pair of windows provided in the side plate 116. Referring now specifically to FIG. 10, an angled push pad 136 is mounted to the bottom of the toning station 10, and a mating push pad 138 is mounted to the frame of the machine, such as frame 28 of FIG. 1. The angled push pad 136 and mating push pad 138 provide additional vertical lift force. The net force is oriented toward the drum photoconductor 12 and up, as indicated by arrow 140. As presented in FIGS. 11 and 12, the registration shoes 62 mounted at either end of the toning station 10 preferably comprise V-shaped notches 63, and the registration pins 56 are received with the notches 63 upon forcing the toning station 10 in the direction of arrow 140. The force holding the toning station 10 in place may exceed 100 lbf, and according to a certain embodiment is on the order of 160 lbf.

The sliding rail 104 comprises a track 105 that toning station 10 is received within and guided upon while being inserted into the machine until all electrical and mechanical interfaces are met. The sliding rail 104 and track 105 serve to accurately locate the toning station 10 in relation to the pins 56 so that, upon activation of the cam shaft 112, the registration pins 56 are received within the notches.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

We claim:

1. An apparatus for developing an electrostatic image, comprising:

a drum photoconductor;

a magnetic brush contacting said drum photoconductor, said magnetic brush comprising a mixture of toner and hard magnetic carriers wherein said magnetic brush comprises a magnetic core within a shell having a center of rotation, and said magnetic core is offset relative to said center of rotation toward said drum photoconductor; and a skive adjacent said shell at an apogee where said shell is furthest from said magnetic core.

2. An apparatus for developing an electrostatic image, comprising:

a drum photoconductor;

a magnetic brush contacting said drum photoconductor, said magnetic brush comprising a mixture of toner and hard magnetic carriers wherein said magnetic brush comprises a magnetic core within a shell having a center of rotation, and said magnetic core is offset relative to said center of rotation toward said drum photoconductor, wherein said shell is closest to said magnetic core at a perigee, said drum photoconductor has a direction of rotation, and said drum photoconductor is closest to said shell at a location offset from said perigee in a direction opposite said direction of rotation.

3. An apparatus for developing an electrostatic image, comprising:

a drum photoconductor;

a magnetic brush contacting said drum photoconductor, said magnetic brush comprising a mixture of toner and hard magnetic carriers wherein said magnetic brush comprises a magnetic core within a shell having a center of rotation, and said magnetic core is offset relative to said center of rotation toward said drum photoconductor; and a skive adjacent said shell at an apogee where said shell is furthest from said magnetic core, and wherein said shell is closest to said magnetic core at a perigee, said drum photoconductor has a direction of rotation, and said drum photoconductor is closest to said shell at a location offset from said perigee in a direction opposite said direction of rotation.

4. An apparatus for developing an electrostatic image, comprising:

a drum photoconductor;

a magnetic brush contacting said drum photoconductor, said magnetic brush comprising a mixture of toner and hard magnetic carriers, wherein said magnetic brush comprises a magnetic core within a shell having a center of rotation, and said magnetic core is offset relative to said center of rotation toward said drum photoconductor; and a skive adjacent said shell at an apogee where said shell is furthest from said magnetic core, and wherein said shell is closest to said magnetic core at a perigee, said drum photoconductor has a direction of rotation, and said drum photoconductor is closest to said shell at a location offset from said perigee in a direction opposite said direction of rotation, and the two are 180° apart.

5. An apparatus for developing an electrostatic image, comprising:

a drum photoconductor;

a magnetic brush contacting said drum photoconductor, said magnetic brush comprising a mixture of toner and hard magnetic carriers wherein said magnetic brush comprises a magnetic core within a shell having a center of rotation, and said magnetic core is offset relative to said center of rotation toward said drum photoconductor; and a skive adjacent said shell at an apogee where said shell is furthest from said magnetic core, and wherein said shell is closest to said magnetic core at a perigee, said drum photoconductor has a direction of rotation, and said drum photoconductor is closest to said shell at a location offset from said perigee in a direction opposite said direction of rotation, and a line drawn from said perigee to said skive is horizontal.

6. A method for developing an electrostatic image, comprising:

applying a mixture of toner and hard magnetic carriers to a drum photoconductor with a magnetic brush comprising a magnetic core within a shell having a center of rotation, and said magnetic core is offset relative to said center of rotation toward said drum photoconductor, and metering said mixture of toner and hard magnetic carriers with a skive adjacent said shell at an apogee where said shell is furthest from said magnetic core.

7. A method for developing an electrostatic image, comprising:

applying a mixture of toner and hard magnetic carriers to a drum photoconductor with a magnetic brush comprising a magnetic core within a shell having a center of rotation, and said magnetic core is offset relative to said center of rotation toward said drum photoconductor, wherein said drum photoconductor has a direction of rotation and further comprising applying said mixture of toner and hard magnetic carriers to said drum photoconductor at a location offset in a direction opposite said direction of rotation from a perigee where said shell is closest to said magnetic core.

8. A method for developing an electrostatic image, comprising:

applying a mixture of toner and hard magnetic carriers to a drum photoconductor with a magnetic brush comprising a magnetic core within a shell having a center of rotation, and said magnetic core is offset relative to said center of rotation toward said drum photoconductor, metering said mixture of toner and hard magnetic carriers with a skive adjacent said shell at an apogee where said shell is furthest from said magnetic core, and wherein said drum photoconductor has a direction of rotation and further comprising applying said mixture of toner and hard magnetic carriers to said drum photoconductor at a location offset in a direction opposite said direction of rotation from a perigee where said shell is closest to said magnetic core.

9. A method for developing an electrostatic image, comprising:

applying a mixture of toner and hard magnetic carriers to a drum photoconductor with a magnetic brush comprising a magnetic core within a shell having a center of rotation, and said magnetic core is offset relative to said center of rotation toward said drum photoconductor, metering said mixture of toner and hard magnetic carriers with a skive adjacent said shell at an apogee where said shell is furthest from said magnetic core, and wherein said drum photoconductor has a direction of rotation and further comprising applying said mixture of toner and hard magnetic carriers to said drum photoconductor at a location offset in a direction opposite said direction of rotation from a perigee where said shell is closest to said magnetic core, and said skive and said perigee are 180° apart.

10. A method for developing an electrostatic image, comprising:

applying a mixture of toner and hard magnetic carriers to a drum photoconductor with a magnetic brush comprising a magnetic core within a shell having a center of rotation, and said magnetic core is offset relative to said center of rotation toward said drum photoconductor, metering said mixture of toner and hard magnetic carriers with a skive adjacent said shell at an apogee where said shell is furthest from said magnetic core, and wherein said drum photoconductor has a direction of rotation and further comprising applying said mixture of toner and hard magnetic carriers to said drum photoconductor at a location offset in a direction opposite said direction of rotation from a perigee where said shell is closest to said magnetic core, and a line from said perigee to said skive is horizontal.

11. A method for developing an electrostatic image, comprising:

applying a magnetic brush to a drum photoconductor, said magnetic brush comprising a mixture of toner and hard magnetic carriers with a mass flow rate; and limiting said mass flow rate of said mixture of toner and hard magnetic carriers to be less than a limiting mass flow rate for which roll-back occurs.

12. The method of claim 11, further where said magnetic brush comprises a shell and further comprising a skive adjacent said shell that controls said mass flow rate.

* * * * *